US006766744B1

(12) United States Patent
Song et al.

(10) Patent No.: US 6,766,744 B1
(45) Date of Patent: Jul. 27, 2004

(54) INCENDIARY DEVICE

(75) Inventors: Eugene Song, Ellicott City, MD (US); Gene V. Tracy, Jarrettsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/341,924

(22) Filed: Jan. 14, 2003

(51) Int. Cl.[7] ..... F42B 12/44

(52) U.S. Cl. ..... 102/364; 102/311; 89/1.13; 86/50

(58) Field of Search ..... 102/282, 283, 102/284, 285, 307, 310, 311, 320, 365, 367, 364, 478, 482; 89/1.13; 86/50

(56) References Cited

U.S. PATENT DOCUMENTS 4,084,078 A * 4/1978 Schroeder ..... 219/121.36
5,271,332 A * 12/1993 Guirguis ..... 102/476
5,698,812 A * 12/1997 Song ..... 102/364

FOREIGN PATENT DOCUMENTS

IT 434632 * 4/1948 ..... 102/364

* cited by examiner

*Primary Examiner*—Michael J. Carone
*Assistant Examiner*—Gabriel S. Sukman
(74) *Attorney, Agent, or Firm*—Ulysses John Biffoni

(57) ABSTRACT

The various embodiments provide an incendiary device utilizing a multiple hollow core-burner technique that facilitates producing large diameter cuts through steel targets. To facilitate this result, the various embodiments incorporate a multiple-core burning design with multiple orifices at the base for directing multiple jets of molten reaction product at the target. The various embodiments further incorporate an optional holding device as a means for locking the device onto a target. Devices in accordance with the invention having a base diameter of 2.312" have been shown to be capable of producing an approximately 2" diameter hole through ¼ inch thick steel plate using a 275 g thermite charge within a container three-quarters the size of a standard AN-M14 Thermite Grenade package.

15 Claims, 4 Drawing Sheets

INCENDIARY DEVICE

GOVERNMENTAL INTEREST

The invention described herein may be manufactured, used and licensed by or for the U.S. Government.

FIELD OF THE INVENTION

The present invention relates generally to incendiary devices, and more particularly, to incendiary devices for producing controlled-diameter holes in metallic targets.

BACKGROUND

In the disposal of unserviceable explosive ordnances, incendiary devices are often used to burn through the ordnance casing and to ignite or otherwise destroy the ordnance payload. Thermite devices are often used for this purpose. Thermite devices are also used for unconventional warfare activities. Examples include the destruction of machinery or metallic structures, or the destruction of biological agents or precursors.

Destruction of metallic targets can be accomplished by cutting a hole through the casing steel and fusing the gears, pistons, and shaft with a stream of molten iron at 4500° F. It has unlimited uses for attacking and destroying transformers, generators, electric motors, engine blocks, gun barrels, breech blocks, and mines. Storage tanks or drums can be cut through, causing the contents to flow out. If the liquid is flammable a fire and deflagration will result.

Destruction of biological agent and/or its precursor can be accomplished with a minimum collateral release by melting through a steel target (such as fermentation equipment, production equipment, storage drum, or warhead) to render the target unusable to an enemy and destroying the fill material by heating and incendiary action.

Thermite, one of the most common pyrotechnic incendiary agents, is essentially a mixture of powdered ferric oxide and powdered or granular aluminum. When raised to its ignition temperature, an intense reaction occurs whereby the oxygen in the ferric oxide is transferred to the aluminum, producing molten iron, aluminum oxide, and releasing approximately 750 kilocalories per gram. The reaction proceeds as follows:

$$8Al+3Fe_3O_4 \rightarrow 4Al_2O_3+9Fe$$

This exothermic reaction may produce a temperature of about 4500° F. under favorable conditions. The white-hot molten iron and slag can itself prolong and extend the heating and incendiary action.

Other types of thermites containing the oxides of other metals in place of iron oxide are known: manganese thermite ($4Al+3MnO_2$), chromium thermite ($2Al+Cr_2O_3$), and others. Iron thermite ($8Al+3Fe_3O_4$) has proved to be the most effective in incendiary composition for destruction of steel targets because superheated liquid products are formed by the reaction. These molten products affect a high rate of conductive heat transfer to the steel target and, therefore, cause destruction of the target.

However, because of the great difficulty in igniting thermite and the almost complete absence of gaseous reaction products, which causes flameless burning and a small radius of action of the hot thermite, iron-thermite is typically not used alone as an incendiary mixture. It is used in multicomponent thermite-incendiary compositions, in which another oxidizer and binder are included, together with thermite. Thermate-TH3, a mixture of thermite and pyrotechnic additives, was found to be superior to thermites and was adapted for use in incendiary hand grenades. Its composition by weight is generally thermite 68.7%, barium nitrate 29.0%, sulfur 2.0% and binder 0.3%. Addition of barium nitrate to thermite increases its thermal effect, creates flame in burning and reduces the ignition temperature.

Previous efforts involving the use of pyrotechnic thermite grenades involved either the welding of two bars or of creating a pile of molten iron slag. Crude and inexpensive pyrotechnic thermite compositions were used to weld railroad rails together without the need for gas torches.

The military application of this technology resulted in the development of the AN-M14 Thermite Grenade circa 1940. It contains approximately 680 g of thermate-TH3 which releases approximately 795 kilocalories per gram of uncontrolled energy through the thin walls of its sheet metal body. This energy however, being undirected, is highly inefficient and insufficient to produce reasonable penetration levels. This M14 grenade would penetrate a ⅛" of mild steel and was used to disable military equipment by placing a large puddle of molten iron slag within a critical part of the item to be disabled.

Current DOD Explosive Ordinance Disposal (EOD) training school identifies the use of the standard AN-M14 incendiary grenade to render disposal of certain explosive ordinances. Unfortunately, the current EOD procedure requires several grenades, as many as 10 grenades, to achieve the desired result and the effect of the grenades in certain applications offers inconsistent effectiveness. Its configuration does not allow sufficient penetration.

A device with greater penetration capabilities is the "Thermite Destructive Device," U.S. Pat. No. 5,698,812 issued Dec. 16, 1997 to Eugene Song. This device was designed to create a forceful jet of molten iron through an opening at the bottom of the containing vessel. One grenade containing approximately 350 g of thermate-TH3 charge is capable of burning through a sheet of 1-inch thick steel plate in about 8 second reaction time. The device utilizes a central core-burning configuration to direct the molten products through an orifice at the bottom of the device.

While this design has merit from a penetration standpoint, and a 350 g charge of thermite could penetrate 1-inch thick steel plate, it is still inadequate to produce reasonable hole size levels. It is only capable of burning a ⅞" diameter hole, which is not sufficient enough for the safe disposal of an unexploded munition. A larger sized hole is needed to prevent a buildup of the internal pressure, and to achieve the successful burnout of the filler explosive. Earlier work has indicated that burning a 3" diameter hole through the outer casing will allow the explosive contained in the bomb to burn without transitioning to a detonation.

For the reasons stated above, and for other reasons stated below that will become apparent to those skilled in the art upon reading and understanding the present specification, there is a need in the art for alternative incendiary devices that are adapted for burning controlled-diameter holes through metallic targets.

SUMMARY

The various embodiments provide an incendiary device utilizing a multiple core-burner technique that facilitates producing large diameter cuts through steel targets. To facilitate this result, the various embodiments incorporate a multiple-core burning design with multiple orifices at the base for directing multiple jets of molten reaction product at the target. The various embodiments further incorporate an optional holding device as a means for locking the device onto a target. Devices in accordance with the invention having a base diameter of 2.312" have been shown to be capable of producing an approximately 2" diameter hole through ¼ inch thick steel plate using a 275 g thermite charge within a container three-quarters the size of a standard AN-M14 Thermite Grenade package.

For one embodiment, the invention provides an incendiary device. The device includes an insulated housing, a vented plug at a top of the housing and a nozzle plate at a bottom of the housing. The nozzle plate includes a plurality of orifices. The device further includes a thermite charge contained in the housing between the vented plug and the nozzle plate. The thermite charge includes a plurality of cores extending a length of the thermite charge between the vented plug and the nozzle plate. Each core is aligned with an orifice of the nozzle plate.

For another embodiment, the invention provides an incendiary device. The device includes a housing having a top and a bottom, a vented plug at the top of the housing, a lid at the top of the housing covering the vented plug, and a nozzle plate at the bottom of the housing. The vented plug includes an adapter for a remote initiation fuse assembly and at least one vent. The lid has a hole corresponding to each vent of the vented plug. The nozzle plate includes a plurality of orifices. The device further includes a compacted thermite charge between the nozzle plate and the vented plug, the thermite charge having a plurality of hollow cores corresponding to the plurality of orifices of the nozzle plate, and a starter material on top of the thermite charge interposed between the vented plug and the thermite charge. An air space is interposed between the starter material and the vented plug. The device still further includes an insulation liner extending from the vented plug to the nozzle plate and interposed between the thermite charge and the housing and a standoff extending below the nozzle plate. The standoff comprises a lip along the circumference or outer edge of the housing only, so that the nozzle plate is spaced apart from the target surface being penetrated. The device still, further includes impermeable seals covering each vent of the vented plug and each orifice of the nozzle plate.

For yet another embodiment, the invention provides an incendiary device having a thermite charge for burning a hole in a target surface. The incendiary device includes means for igniting the thermite charge, thereby producing molten reaction products, and means for producing a plurality of jets of the molten reaction products in an arrangement approximating a shape of a desired burn in the target surface.

The invention further includes other apparatus of varying scope.

DETAILED DESCRIPTION

In the following detailed description of the present embodiments, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that process, electrical or mechanical changes may be made without departing from the scope of the present invention. The following detailed description is, therefore, not to be taken in a limiting sense, and the scope of the present invention is defined only by the appended claims and equivalents thereof.

Figure 1A:
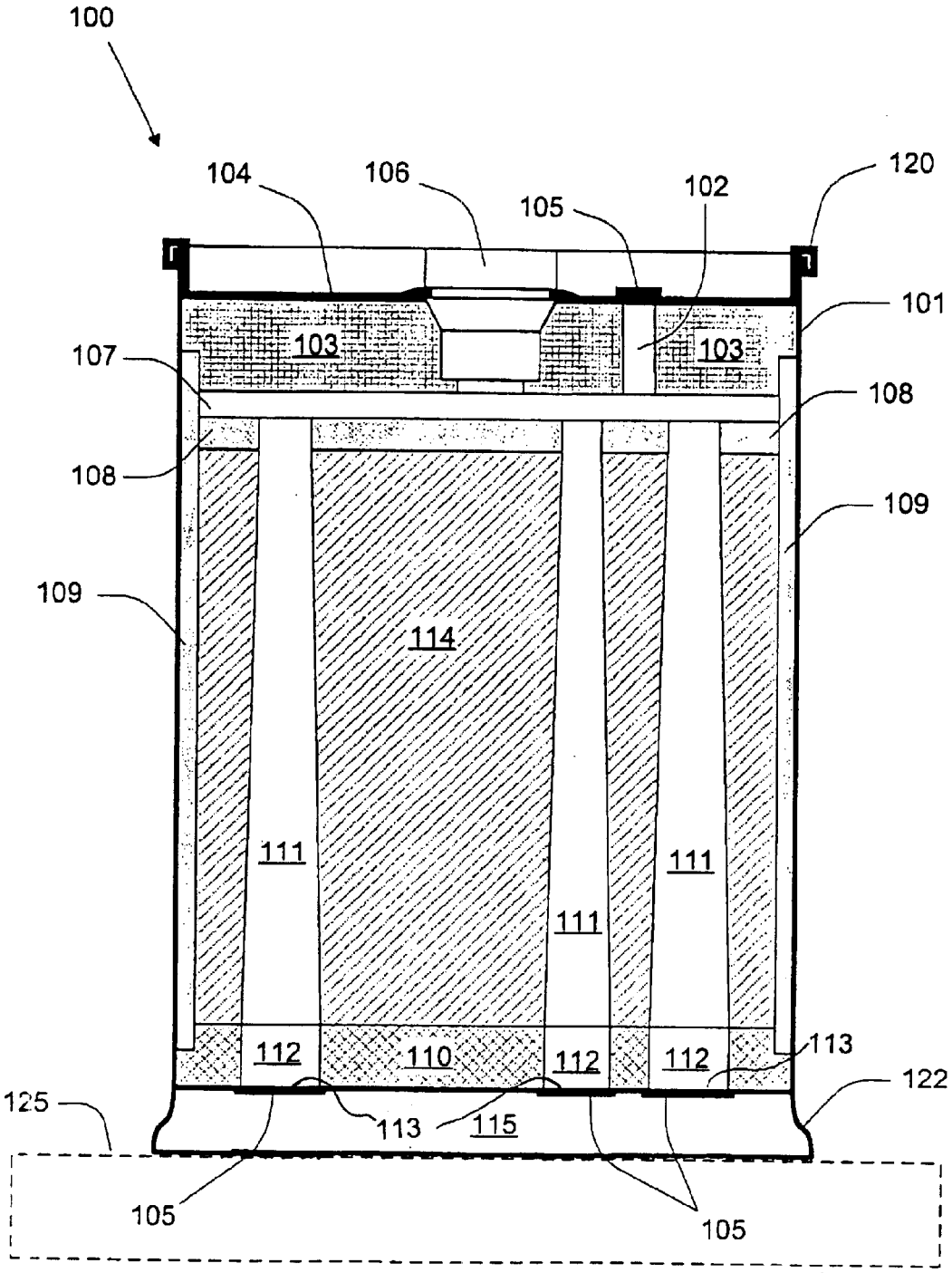
FIG. 1A is cross-sectional view of an incendiary device in accordance with an embodiment of the invention.
Figure 1B:
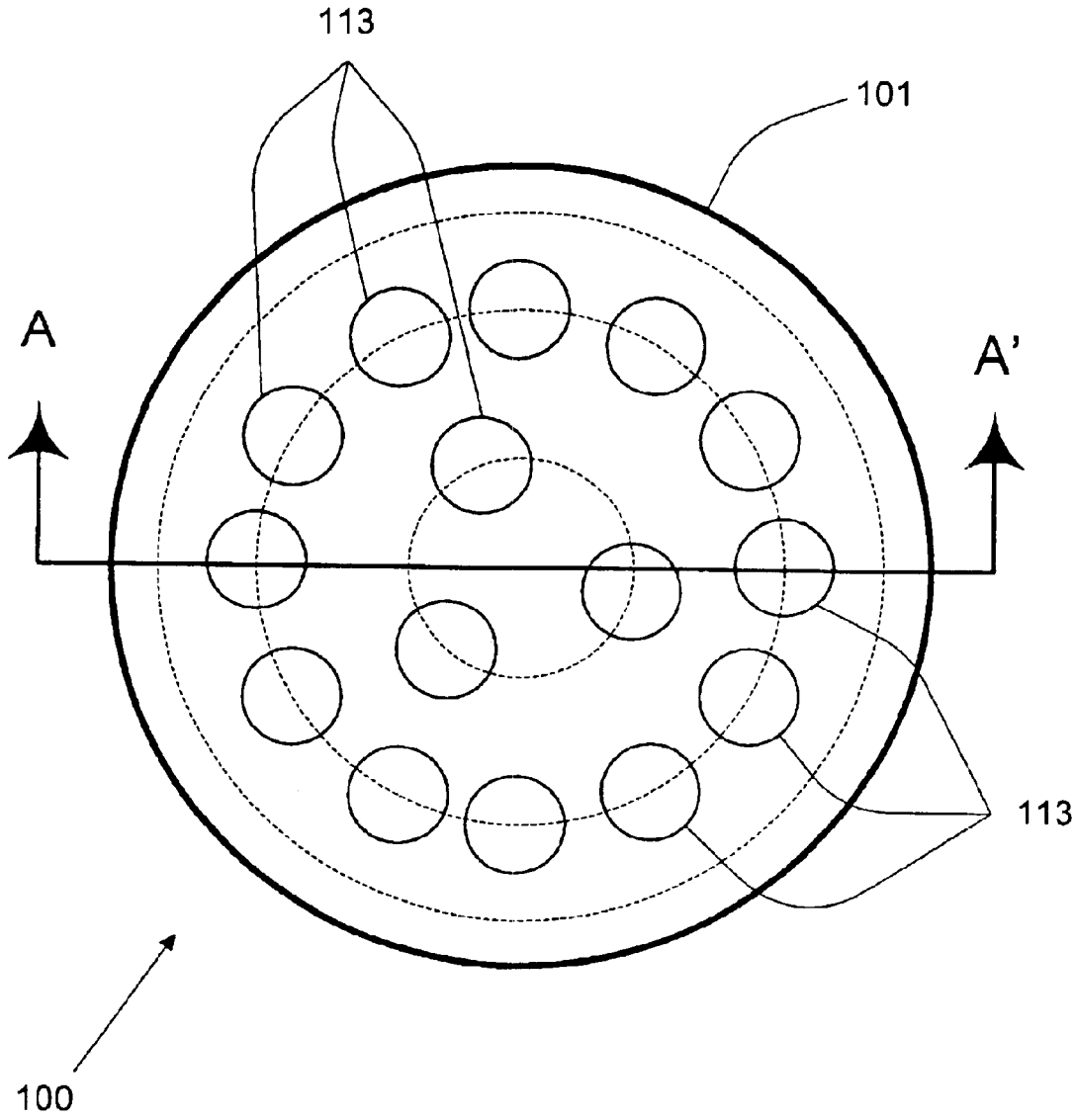
FIG. 1B is a bottom view of the incendiary device of FIG. 1A.

FIGS. 1A–1B depict an incendiary device 100 in accordance with an embodiment of the invention. FIG. 1A is a cross-sectional view of the incendiary device 100 taken along a line A–A' of FIG. 1B, a bottom view of the incendiary device 100. Referring to FIG. 1A, the device body comprises a housing 101 and a lid 104 which may be constructed of any suitable material able to withstand the effects of rough handling, e.g., sheet metal or plastic. The bottom of the housing 101 may contain a circumferential skirt 122 having a diameter larger than a diameter of a body portion of the housing 101 containing the thermite charge 114.

The housing 101 has a plurality of exit holes 113 in the bottom, and contains an insulation liner 109 and a nozzle plate 110, made of graphite or other refractory material capable of withstanding the reaction temperature of the specific thermite selected. The nozzle plate 110 has a plurality of orifices 112 in alignment with the matching exit holes 113 at the bottom. A thermite charge 114, suitably of the $Fe_3O_4$ and Al type described above, will be consolidated into the insulated housing 101 such that multiple hollow cores 111 extend downward along the entire length of the charge through the matching orifices 112 at the bottom. Illustrative but without limitation, the consolidation may be done in several increments with the consolidation pressure in the range of 3000 to 4000 psig, which will assure a uniform and compact thermite charge. For one embodiment, the hollow cores 111 have a conically-shaped channel having base and top diameter of ½-inch and ⅜-inch, respectively. However, the hollow cores 111 may also be substantially cylindrical or have tapers of varying degree. A standoff 115 at the bottom of the device insures a separation between the orifices 112 and the material under attack. The standoff 115 comprises a lip along the circumference or outer edge of the bottom of the device only, so that the exit holes 113 are separated from the target surface 125 being penetrated.

A starter material 108 is pressed on top of the thermite charge 114. The starter material 108 may be any material that is readily ignitable upon application of flame, or lighted fuse, and has sufficient thermal output to reliably ignite the thermite charge 114. One example of a starter material includes a mixture of Potassium Nitrate (66 parts by weight), Titanium (11 parts by weight), Aluminum (8 parts by weight), Silicon (6 parts by weight), Sulfur (2 parts by weight), Charcoal (5 parts by weight), and Polyacrylic rubber (2 parts by weight).

The vented plug 103, made of graphite or other refractory material capable of withstanding the reaction temperature of the specific thermite selected, having one or more vent holes 102, rests over the top of the insulation liner 109. The vented plug 103 acts as a baffle for the exit of molten product materials and also acts as a radiation shield, thus helping retain the heat produced. Manipulation of vented plug 103 and orifice 112 designs make it possible to control the pressure of the jets of molten products of reaction through the orifices 112 at the bottom. The lid 104 has one or more holes in alignment with vent holes 102 and is tightly closed by any conventional means, e.g., crimping. The vent holes 102 in the top and the exit hole 113 in the bottom are sealed from outside by seals 105, e.g., a thin metal adhesive disc of foil 105, preferably aluminum, or other impermeable membrane. The seals 105 serve to inhibit migration of moisture into the body 101.

The multiple hollow cores 111 formed in the compacted thermite charge 114 allow the reaction front to progress both radially outward and axially downward through the charge 114, thus permitting the molten mass to be pushed out of the orifices 112 at the base immediately upon ignition until completion of the reaction. This would result in multiple high velocity jets exiting from the orifices 112, thus facilitating a large diameter circular cut of a steel plate. In addition, the cores 111 increase the burning surface areas and consequently the burn rate. A small air space 107 above the thermite charge 114, suitably about 0.5-inch in height, along with the vented plug 103 provide some restriction of the expanding gases within the device which results in enough pressure increase to aid in jetting of the molten reaction products through the orifices 112. The number and size of the vents 102 can be adjusted to provide a desired backpressure, thereby controlling the exit pressure of the molten reaction products from the orifices 112.

While the orifices 112 and holes 113 are arranged in substantially concentric rings in the embodiment depicted in FIGS. 1A–1B, other arrangements are possible. For example, the orifices 112 and holes 113 may be arranged in oval or polygonal shapes roughly approximating the shape of the desired burn to be made in the target surface 125. Similarly, the arrangement of orifices 112 and holes 113 depicted in FIGS. 1A–1B may include more or less concentric rings for increasing or decreasing the area of burn of the target surface 125.

For safety considerations, the explosive ordnance disposal procedures must generally be performed remotely. A remote initiation fuse assembly is fitted into the adapter 106 in the top of the device. The remote fuse (not shown) may be any type that is capable of igniting the starter materials 108 which in turn ignite the thermite charge 114. The fuse should desirably be an electric or timed fuse.

For one example embodiment, the incendiary device is a cylindrical container filled with approximately 0.6 lb of incendiary mixture. The body is a thin sheet metal cylinder approximately 2.3 inches in diameter by 3.5 inches high, with eight exit holes in the bottom and three vent holes in the top. The device body is equipped with a pre-formed graphite insulation liner with an orifice plate at the base and vent plate at the top. The incendiary fill is consolidated into the insulated body with eight formed hollow cores. The top of the fill and the multiple hollow cores are covered with a starter mixture. The holes in the top and bottom of the device are covered with an adhesive moisture barrier. The device includes 8 hollow cores having a nominal diameter of 7/16 inches, three vent holes having a nominal diameter of 0.2344 inches, and a standoff distance of approximately 0.5 inches. Such a device has been shown to be capable of producing a hole of approximately 2 inches in diameter through a ¼-inch thick steel plate.

For another example embodiment, the incendiary device is a cylindrical container filled with approximately 3.5 lb of incendiary mixture. The body is a thin sheet metal cylinder approximately 4 inches in diameter by 6.25 inches high, with twelve exit holes in the bottom and three vent holes in the top. The device body is equipped with a pre-formed graphite insulation liner with an orifice plate at the base and vent plate at the top. The incendiary fill is consolidated into the insulated body with twelve formed hollow cores. The top of the fill and the multiple hollow cores are covered with a starter mixture. The holes in the top and bottom of the device are covered with an adhesive moisture barrier. The device includes 12 hollow cores having a nominal diameter of ½ inches, three vent holes having a nominal diameter of ½ inches, and a standoff distance of approximately ¾ inches. Such a device has been shown to be capable of producing a hole of approximately 3.5 inches in diameter through a ½-inch thick steel plate.

Figure 2:
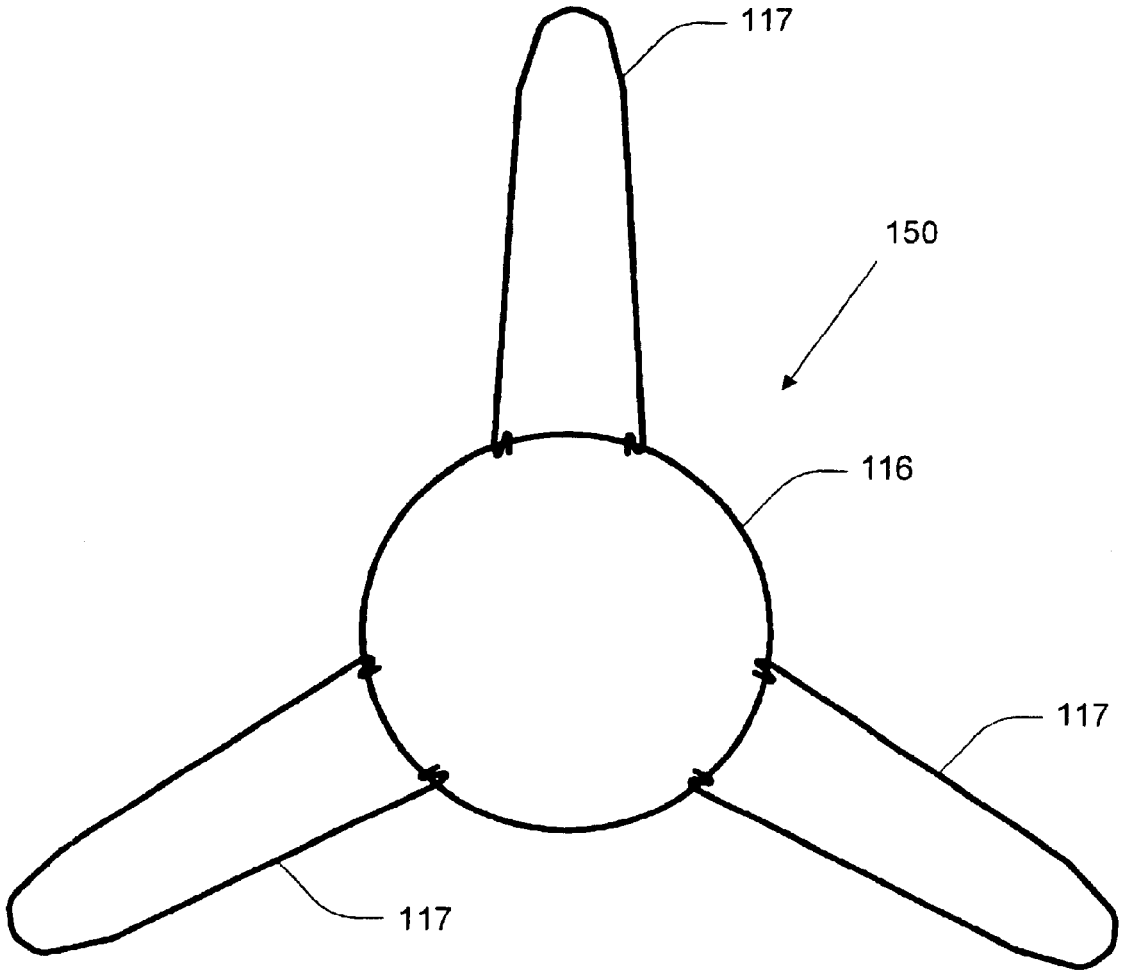
FIG. 2 is a top view of a harness for use with the incendiary device of FIGS. 1A–1B.

FIG. 2 is a top view of a harness 150 for use with the incendiary device of FIGS. 1A–1B. The harness 150 may be used to facilitate attachment of the incendiary device 100 to a target surface 125. The harness 150 includes a ring 116 having a diameter large enough to fit over the housing 101 of the incendiary device 100 yet having a diameter smaller than the circumferential skirt 122 of the housing 101. One or more hands or other appendages 117 may be attached to and extend from the ring 116 for use in attaching the harness 150 to the target surface 125. In a simple construction, the ring 116 may be a ring of wire. The hands 117 may include a wire loop coiled around the ring 116 for attachment.

Figure 3A:
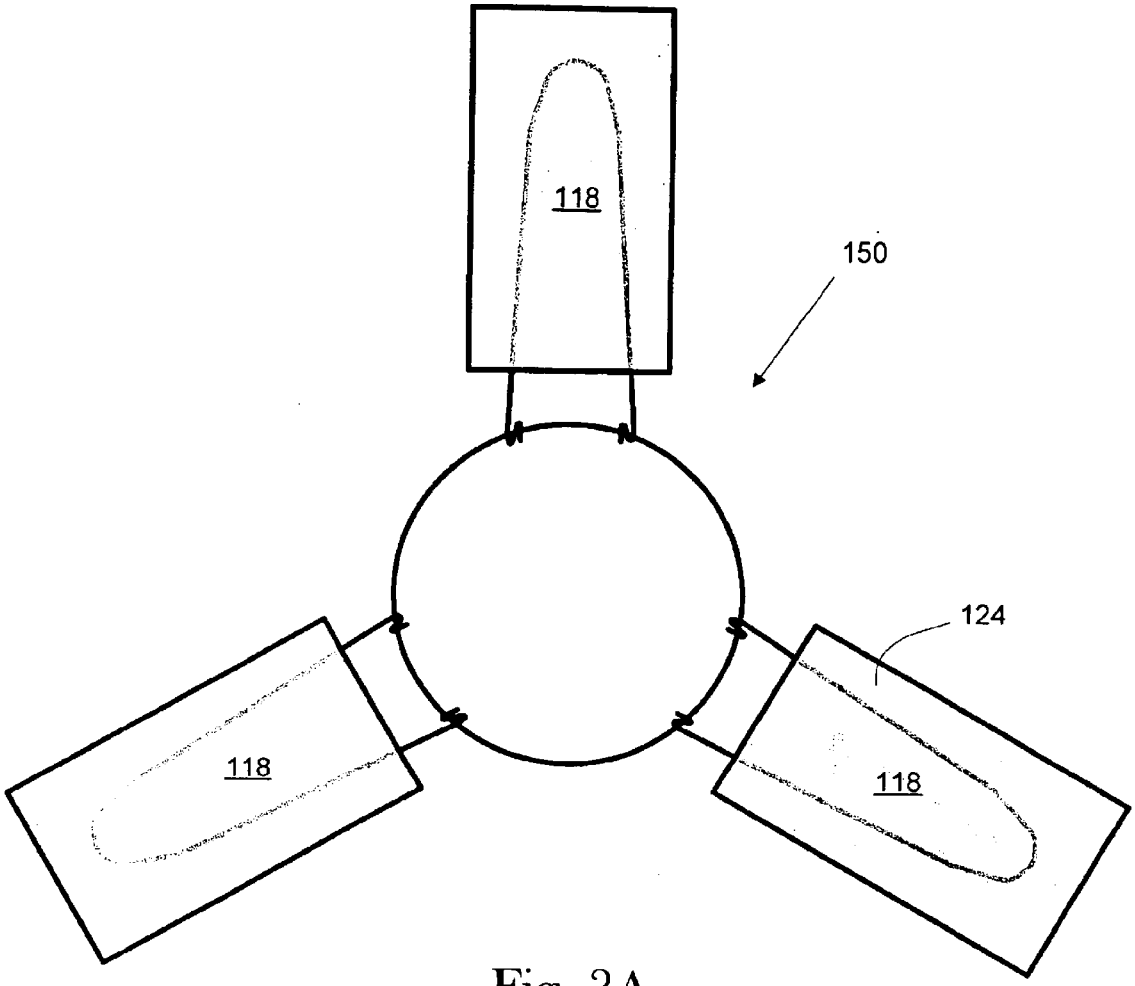
FIG. 3A is a top view of the harness of FIG. 2 with added hold-downs.

FIG. 3A is a top view of a harness 150 having hold-downs 118 attached to the hands 117. The hold-downs 118 are generally adapted to the type of surface to which the incendiary device 100 is to be attached. For example, if the target surface 125 is a ferrous metal, the hold-downs 118 could be magnets. However, it is found that adhesive hold-downs 118 are probably more universally suitable for a variety of surfaces.

Figure 3B:
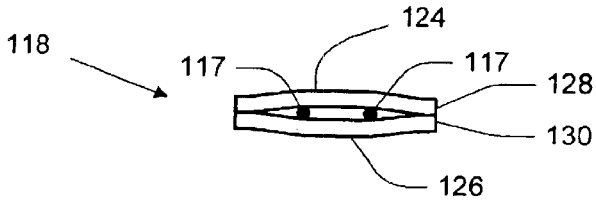
FIG. 3B is cross-sectional view of a hold-down of FIG. 2

FIG. 3B is a cross-sectional view of a hold-down 118 formed of two pieces of double-sided foam tape, e.g., 3M™ 4930 VHB™ Double Coated Acrylic Foam Tape, available from 3M, St. Paul, Minn., USA. Such tapes contain a pressure-sensitive adhesive on opposing surfaces of a foam carrier. Each surface of these foam tapes contains a removable liner.

A first piece of foam tape 128 can maintain its liner on an outer surface 124. A second piece of foam tape 130 can maintain its liner on an outer surface 126 until ready for attachment to a target surface 125. The remaining surfaces of the first piece of foam tape 128 and the second piece of foam tape 130 may be placed around an arm 117 and attached to each other by their exposed adhesive surfaces. When ready to attach the harness 150 to a target surface, the liner may be removed from the surface 126, thereby exposing its adhesive layer.

CONCLUSION

The various embodiments provide an incendiary device utilizing a multiple core-burner technique that facilitates producing large diameter cuts through steel targets. To facilitate this result, the various embodiments incorporate a multiple-core burning design with multiple orifices at the base for directing multiple jets of molten reaction product at the target. The various embodiments further incorporate an optional holding device as a means for locking the device onto the target.

Devices in accordance with the invention having a base diameter of 2.312" have been shown to be capable of producing an approximately 2" diameter hole through ¼ inch thick steel plate using a 275 g thermite charge within a container three-quarters the size of a standard M14 package.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. An incendiary device, comprising:

an insulated housing;

a vented plug at a top of said housing;

a nozzle plate at a bottom of said housing and comprising a plurality of orifices; and a thermite charge contained in said housing between said vented plug and said nozzle plate, wherein said thermite charge further comprises a plurality of hollow cores extending a length of said thermite charge between said vented plug and said nozzle plate, each core aligned with an orifice of said nozzle plate, and wherein said cores are arranged in a plurality of concentric rings.

2. The incendiary device of claim 1, wherein said thermite charge comprises a thermite composition selected from the group consisting of a manganese thermite, a chromium thermite, and an iron thermite.

3. The incendiary device of claim 2, wherein said thermite charge further comprises another oxidizer and a binder.

4. The incendiary device of claim 1, wherein said hollow cores taper outwardly as said cores extend toward their corresponding orifice.

5. The incendiary device of claim 1, wherein said vented plug and said nozzle plate each comprise a refractory material and said housing is insulated with a refractory material.

6. The incendiary device of claim 5, wherein said refractory material for at least one of said vented plug, said nozzle plate and said housing insulation is graphite.

7. The incendiary device of claim 1, further comprising:

a standoff comprising a lip along a circumference or outer edge of a bottom of said housing, providing a separation between said orifices in said nozzle plate and a target surface.

8. The incendiary device of claim 7, further comprising a harness for attaching the incendiary device to the target surface.

9. The incendiary device of claim 8, further comprising a circumferential skirt at said standoff, wherein said harness has a ring adapted to fit over said housing and said ring has a diameter less than a diameter of said circumferential skirt.

10. An incendiary device, comprising:

a housing having a top and a bottom;

a vented plug at the top of said housing, said plug having an adapter for a remote initiation fuse assembly and having at least one vent;

a lid at the top of said housing covering said vented plug and having a hole corresponding to each vent of said vented plug;

a nozzle plate at the bottom of said housing, said nozzle plate having a plurality of orifices;

a compacted thermite charge between said nozzle plate and said vented plug, said thermite charge having a plurality of hollow cores corresponding to the plurality of orifices of the nozzle plate, and wherein said cores are arranged in a plurality of substantially concentric rings;

a starter material on top of said thermite charge interposed between said vented plug and said thermite charge;

an air space interposed between said starter material and said vented plug;

an insulation liner extending from said vented plug to said nozzle plate and interposed between said thermite charge and said housing;

a standoff extending below said nozzle plate, said standoff providing a separation between the orifices of said nozzle plate and a target surface; and impermeable seals covering each vent of said vented plug and each orifice of said nozzle plate.

11. The incendiary device of claim 10, wherein said hollow cores are conically-shaped channels having a base diameter greater than a top diameter.

12. The incendiary device of claim 11, wherein said base diameter is approximately ½-inch and said top diameter is approximately ⅜-inch.

13. The incendiary device of claim 11, wherein said hollow cores are arranged in two concentric rings.

14. An incendiary device for burning a hole in a target surface, said incendiary device comprising:

a thermite charge, wherein said thermite charge further comprises a plurality of hollow cores extending a length of said thermite charge, and wherein said cores are arranged in a plurality of substantially concentric rings;

means for igniting said thermite charge thereby producing molten reaction products; and means for producing a plurality of jet of said molten reaction products, and wherein said means for producing a plurality of jets of said molten reaction products further comprises means for controlling an exit pressure of said plurality of jets of said molten reaction products.

15. The incendiary device of claim 14, further comprising means for attaching said incendiary device to said target surface.

* * * * *